US005802801A

United States Patent [19]

Hohns et al.

[11] Patent Number: 5,802,801

[45] Date of Patent: Sep. 8, 1998

[54] LOCKER DOOR AND FRAME ASSEMBLY

[76] Inventors: Charles D. Hohns, Box, R.D. #5, Malvern, Pa. 19355; James Benenson, Jr., 1 Lexington Ave., New York, N.Y. 10010

[21] Appl. No.: 739,919

[22] Filed: Oct. 30, 1996

Related U.S. Application Data

[63] Continuation-in-part of Ser. No. 429,331, Apr. 25, 1995, abandoned, which is a continuation-in-part of Ser. No. 359,586, Dec. 20, 1994, abandoned.

[51] Int. Cl.[6] ..... E04C 2/32

[52] U.S. Cl. ..... 52/792.1; 52/792.1; 52/782.1; 52/404.4; 49/504; 312/257.1; 312/293.2; 108/64; 428/120; 428/124.1; 428/595

[58] Field of Search ..... 52/792.1, 792.11, 52/782.1, 404.4; 248/346; 428/120, 124.1, 595, 124, 126, 127, 128; 49/504; 312/293.2, 257.1; 108/64

[56] References Cited

U.S. PATENT DOCUMENTS

| | | | |
|---|---|---|---|
| 2,161,037 | 6/1939 | Gould . | |
| 2,557,412 | 6/1951 | Clements . | |
| 3,056,475 | 10/1962 | Benham . | |
| 3,137,922 | 6/1964 | Schumacher . | |
| 3,287,854 | 11/1966 | Dasovic et al. . | |
| 3,848,324 | 11/1974 | Perger . | |
| 4,172,167 | 10/1979 | Greene et al. . | |
| 4,447,099 | 5/1984 | French et al. | 312/257.1 |
| 4,515,838 | 5/1985 | Miyajima . | |
| 4,836,636 | 6/1989 | Taylor et al. | 312/257.1 |
| 5,121,593 | 6/1992 | Forslund . | |
| 5,511,873 | 4/1996 | Mech | 312/293.2 X |

OTHER PUBLICATIONS

Erectomatic Hi–Performance Shelving Catalog pp. 1–16 Dated Sep. 1992.

*Primary Examiner*—Creighton Smith
*Assistant Examiner*—W. Glenn Edwards
*Attorney, Agent, or Firm*—Caesar, Rivise, Bernstein, Cohen & Pokotilow, Ltd.

[57] ABSTRACT

A locker door and frame assembly including a one-piece locker door having integral box beam supports at the extreme side edges of a central rectangular panel of the door and including hinge means directly connected to one marginal area of one of the integral box beam supports and to an adjacent side frame member of the frame for pivotally connecting the locker door to the frame through one of the integral box beam supports. A single-point latch system is located adjacent the side edge of the door remote from the hinge side for use in locking the door to the frame at only a single point spaced intermediate the opposed end edges of the door. The box beam supports can be of a number of different cross-sections, and most preferably the box beam support adjacent the hinge side of the door is wider than the box beam support adjacent the latch side of the door.

22 Claims, 5 Drawing Sheets

FIG. 1
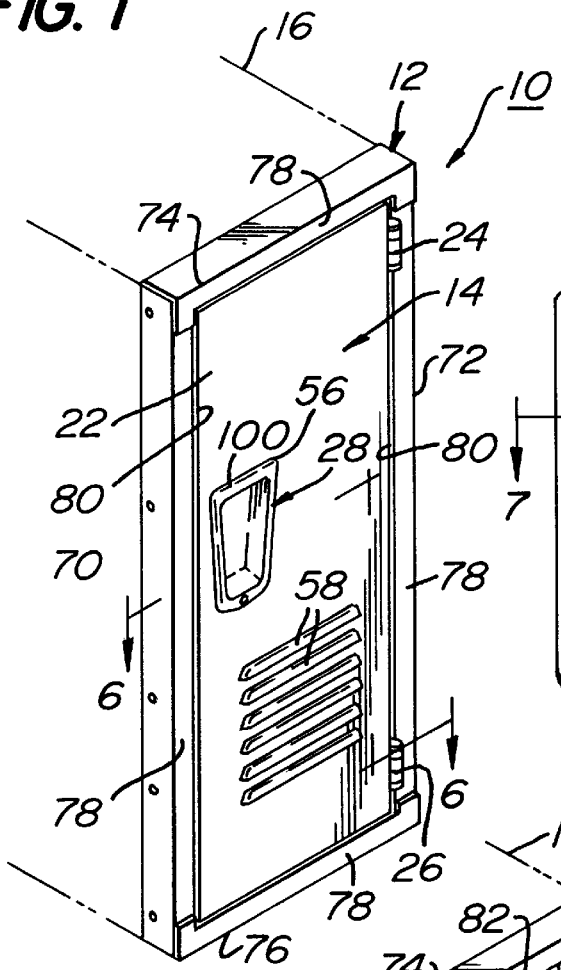
FIG. 3
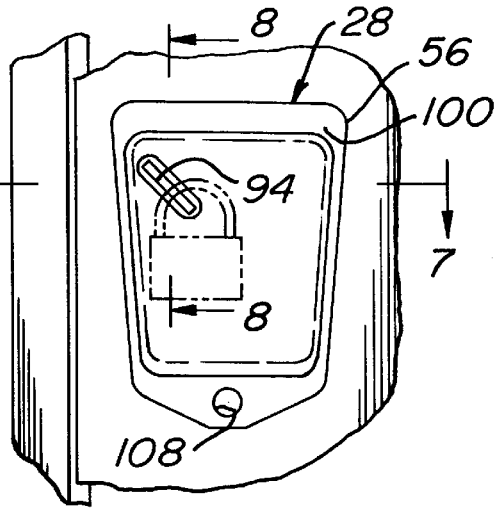
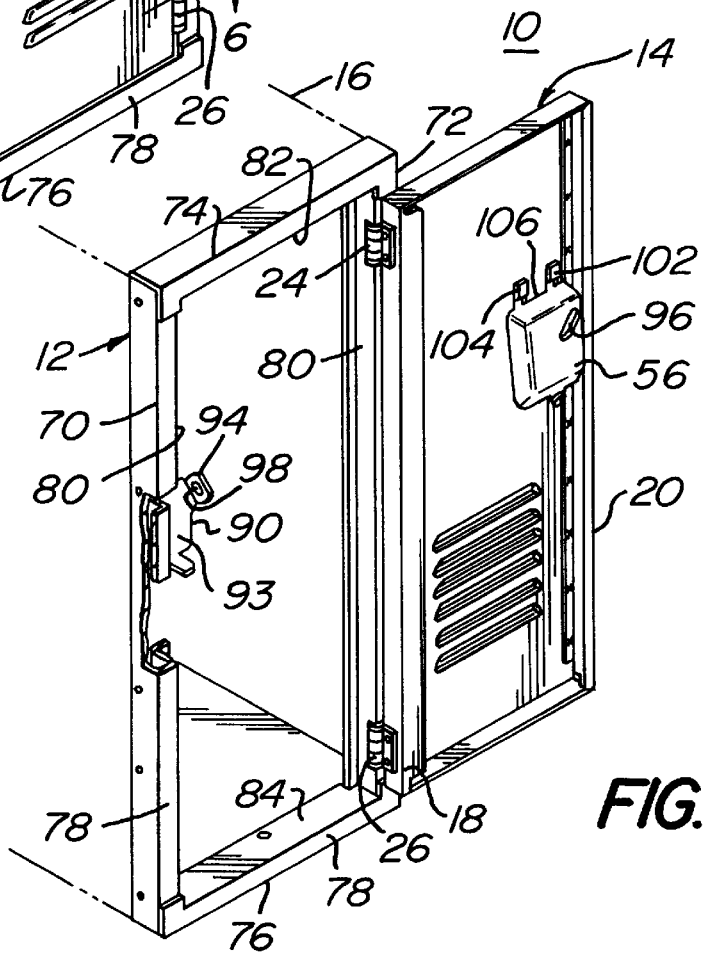
FIG. 2

FIG. 12
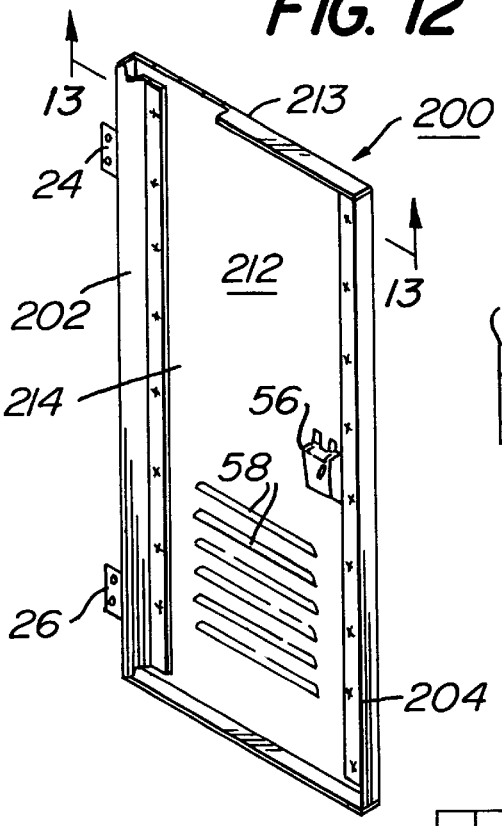
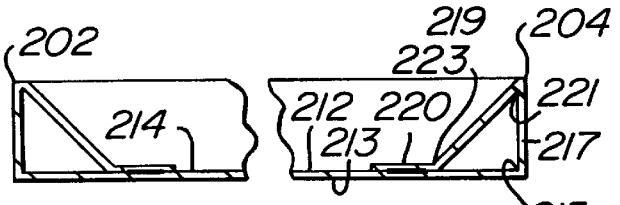
FIG. 13
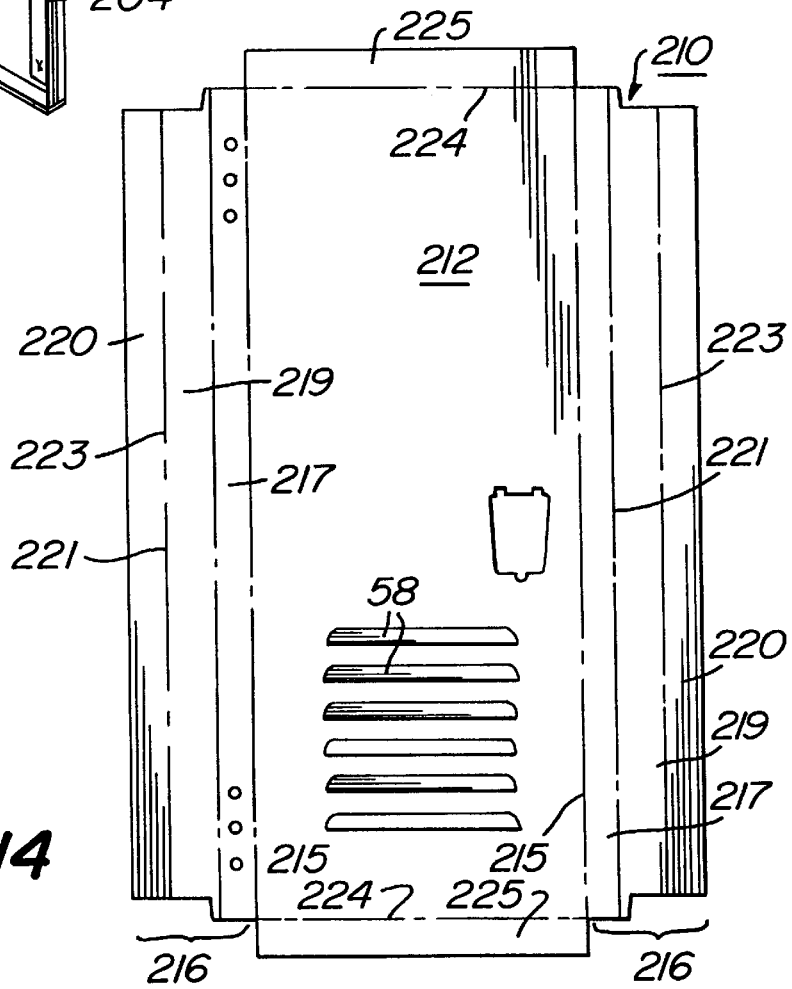
FIG. 14

LOCKER DOOR AND FRAME ASSEMBLY

This application is a Continuation-in-Part of application Ser. No. 08/429,331, filed on Apr. 25, 1995, now abandoned, which is a Continuation-in-Part of application Ser. No. 08/359,586, filed Dec. 20, 1994, now abandoned.

BACKGROUND OF THE INVENTION

The present invention relates to sheet metal locker door and frame assemblies and more particularly to an improved assembly including a one-piece metal locker door.

Metal lockers are popular for use in a wide variety of environments, including schools, airports, athletic clubs, businesses, and factories, where it is necessary or desirable for users to store their clothing and other belongings. Metal lockers have the advantage over wooden lockers in that they are less expensive and are easier to clean and maintain. It is a common practice to provide metal lockers with doors that either are reinforced along one of the vertical edges of the door with a reinforcing pan or by a complete second skin. Reinforcing pans are a second part that must be made separately and welded to the door. This is an expensive operation and the size of the pan precludes normal ventilation louver and perforation placement on the door. Where a second skin is used, this construction requires two door pans to be manufactured and welded together. The front and rear faces which are spaced the thickness of the door present a problem when ventilating and painting the locker. Air flow through louvers in such a door is reduced as compared to single skin doors, and perforated doors with a second skin are unsightly, and are difficult and costly to paint.

Metal lockers pose significant problems that are not encountered in other types of storage devices (e.g., refrigerators, freezers, etc.,). First, in a number of environments where metal lockers are employed (e.g., schools, athletic clubs, etc.) vandalism and theft are significant problems. Specifically, it is not uncommon for vandals and thieves to attempt to break into lockers by attempting to pry the locker door away from its attached frame. This is often accomplished by the insertion of a tool at a corner of the door opposite the hinge, (i.e., on the latch side of the door) and then prying the door to bend and/or separate the door from its attached frame.

A second problem inherent in the use of lockers is the significant beating they take in the environments in which they are used. This necessitates a locker design which is durable, rugged and capable of withstanding harsh usage conditions.

An additional problem encountered in locker constructions is the need to provide adequate ventilation for the interior compartment which is particularly desirable when sweaty athletic clothes is intended to be stored in the lockers.

The above enumerated problems, which need to be addressed in the design of locker door and frame assemblies of the type forming the subject matter of the present invention, are not a problem in other types of storage devices, such as refrigerators and freezers, or require solutions that are not adaptable to such other types of storage devices.

U.S. Pat. No. 4,172,167, issued to Greene et al., discloses the general construction of a one piece sheet metal door having a peripheral rib about all four edges thereof. Doors of this type generally are used on coolers, refrigerators and freezers, and employ a seal between the inwardly facing surface of the peripheral rib and a portion of the casing of the device.

The peripherally-ribbed sheet metal door disclosed in Greene et al. is not suitable for use as part of a locker door and frame assembly of the type forming in the subject matter of the present invention. Specifically, the peripheral ribs associated with all four sides of the Greene et al. door preclude the door from being set within the frame of a locker, and also from being hinged to the frame in the manner required in the present invention. Moreover, there is absolutely no teaching in Greene et al. of employing a hinge and latch arrangement that could be usable in a locker door and frame assembly of the type formed in the subject matter of the present invention.

Sheet metal shelving employing box beam supports at the front and rear edges of the shelving are known. These supports add structural integrity to the shelf so that the shelf can support heavy static loads in a horizontal plane. Such prior art shelving have absolutely no bearing on door constructions in general, or locker door and frame assemblies, in particular. Specifically, the strength imparted to the prior art shelving by the box beam supports at the front and rear edges thereof is for supporting a horizontal load while maintained in a static condition. This is in distinction to a locker door and frame assembly employing a single point latch, wherein the locker door is movable in a vertical plane about hinge means and needs to be constructed to resist twisting stresses at the hinge side and to resist bending above and below the single point latch on the latch side, while not unduly restricting the open area into the locker.

It should be apparent from the above discussion that it is very desirable to provide a locker door and frame assembly which is of a economical and low cost construction, which permits adequate ventilation for the locker, which permits ease of painting, which provides an aesthetically appealing visual appearance, and which employs a one-piece metal locker door having stiff/rigid, vertical edges at both the hinge and latch sides thereof to resist prying forces imposed upon the door by vandals and to provide a connecting hinge assembly between the door and frame which resists twisting forces and is not easily broken or damaged by vandals.

OBJECTS OF THE INVENTION

It is a general object of this invention to provide a locker door and frame assembly which is economical to construct and reliable in operation.

It is a more specific object of this invention to provide a locker door and frame assembly which is sufficiently stiff and rigid to resist efforts by vandals to break into lockers employing such an assembly.

It is a further object of this invention to provide a locker door and frame assembly wherein the hinge connection between the locker door and frame resists tampering by vandals.

It is still a further object of this invention to provide a locker door and frame assembly wherein the locker door can be economically and efficiently manufactured and/or painted.

It is still a further object of this invention to provide a locker door and frame assembly wherein the locker door is adequately ventilated.

It is a more specific object of this invention to provide a locker door and frame assembly employing a single point latch between the locker door and frame, and wherein the door is stiff and rigid at opposed vertical edges to resist being separated from the frame by vandals.

SUMMARY OF THE INVENTION

The above and other objects of this invention are achieved in a locker door and frame assembly including a one-piece locker door having a central, rectangular panel and a pair of integral box beam supports. The rectangular panel has outer and inner surfaces, a pair of opposed side edges, and a pair of opposed end (i.e., upper and lower) edges. The integral box beam supports are located at the extreme side edges of the rectangular panel to permit the entire door to be set within peripheral sides of the frame.

Each of the side edges of the one-piece locker door is provided by a first outer marginal fold zone extending for the length of the side, and each of the box beam supports is provided by a marginal portion of the locker door integrally joined to the panel through a respective first outer marginal fold zone and extending outwardly of the panel. Each of the marginal portions include multiple, adjacent marginal areas integrally joined to each other through additional marginal fold zones spaced outwardly from the first outer marginal fold zone. The marginal areas of each of the marginal portions are bent along the first outer marginal fold zone and the additional marginal fold zones to form each of the integral box beam supports.

Each of the integral box beam supports include a first marginal area joining the central, rectangular panel through the first outer marginal fold zone and extending approximately perpendicular to the panel and outwardly from the inner surface at the extreme side edge of the panel. Each of the integral box beam supports also includes at least two (2) additional marginal areas within the perimeter of the panel and these additional marginal panels are bent relative to each other along one of the additional marginal fold zones with one of the at least two (2) additional marginal areas being directed inwardly toward the inner surface of the panel and another of the at least two (2) additional marginal areas extending parallel to and generally flush against the inner surface of the panel, said one of the additional fold zones being transversely spaced inwardly from the first outer marginal fold zone.

The frame includes transversely spaced apart side frame members having outwardly facing front surfaces and transversely spaced-apart, confronting side surfaces. The metal locker door is disposed completely within the frame with the first marginal area of each of the integral box beam supports being disposed in contiguous, overlying relationship with an adjacent side surface of one of said side frame members and with no portion of the locker door overlying the outwardly facing front surfaces of the side frame members.

Hinge means for the locker door are directly connected to a first marginal area of one of the integral box beam supports and to an adjacent side frame member for pivotally connecting the locker door to the frame through one of the integral box beam supports.

In the most preferred form of this invention, a single-point latch means is provided adjacent the side edge of the door remote from the hinge means for use in locking the door to the frame at only a single location spaced intermediate the opposed end edges of the door.

In a preferred embodiment of this invention, the hinge means include members that are connected to the first marginal area of one of the integral box beam supports and to an adjacent side frame member, respectively, by screws, rivets, welds, or other suitable fastening means, which remain unexposed when the locker door is in a closed position within the frame.

In a preferred form of this invention, a pair of hinge means is positioned closely adjacent the end edges of the door adjacent one side edge thereof, and the single-point latch means is positioned in an intermediate section of the door adjacent the opposed side edge thereof. However, it should be understood that in accordance with the broadest aspect of this invention the number of hinge means can be varied, as desired, and in fact, the hinge means can even be a single continuous hinge.

In the most preferred form of this invention, the locker door is provided with air ventilating passages therein; most preferably in the central rectangular panel thereof.

In the most preferred form of this invention, the integral box beam support adjacent the hinge side of the door is wider than the box beam support adjacent the latch side of the door. The wider box beam support at the hinge side provides an extremely stiff and rigid construction to resist twisting forces. The narrower box beam support adjacent the latch side provides desired stiffness thereat while at the same time permitting the single point latch member on the door to be located close to its adjacent side frame member to minimize interference with access to the internal compartment of a locker employing the locker door and frame assembly of this invention.

Most preferably each of the end (i.e., top and bottom) edges of the panel is defined by an outer end marginal fold zone extending the length of the end outwardly beyond and along which is an outer end marginal portion integral with the panel. Each end marginal portion is folded perpendicular to the panel along its respective end marginal fold zone and over the ends of the integral box beam supports to strengthen the locker door and to provide a cover for the ends of the box beam supports. If desired, air ventilating passages can be provided in each of the end marginal portions, in the form of spaced-apart openings along the length thereof.

In a preferred form of the invention, the one-piece metal locker door of the assembly is provided with four-sided (i.e., quadrilateral) integral box beam supports at the elongate sides thereof. In this embodiment, each of the marginal portions has four marginal areas that are bent into said four-sided box beam supports.

In another form of the invention the one-piece metal locker door of the assembly is provided with three-sided integral box beam supports at the opposed elongate sides thereof. In this embodiment, each of the marginal portions has three marginal areas that are bent into said three-sided box beam supports.

BRIEF DESCRIPTION OF THE DRAWINGS

FIG. 1 is an isometric view of a locker door and frame assembly of this invention showing a portion of a conventional locker housing in phantom;

FIG. 2 is an isometric view similar to FIG. 1, but showing the locker door of the assembly in an opened position;

FIG. 3 is an enlarged fragmentary view illustrating a single-point latch system usable in the locker door and frame assembly of this invention;

FIG. 12 is an isometric view of the rear side of a further alternative embodiment of a locker door utilizable in the assembly of this invention, with the front side of the locker door being identical in appearance to the front side of the locker door shown in FIG. 1;

FIG. 13 is a sectional view taken along the line 13—13 of FIG. 12.

FIG. 14 is a plan view of the one-piece sheet metal blank from which the door of FIGS. 12 and 13 may be formed.

DESCRIPTION OF THE PREFERRED EMBODIMENTS OF THE INVENTION

Figure 4:
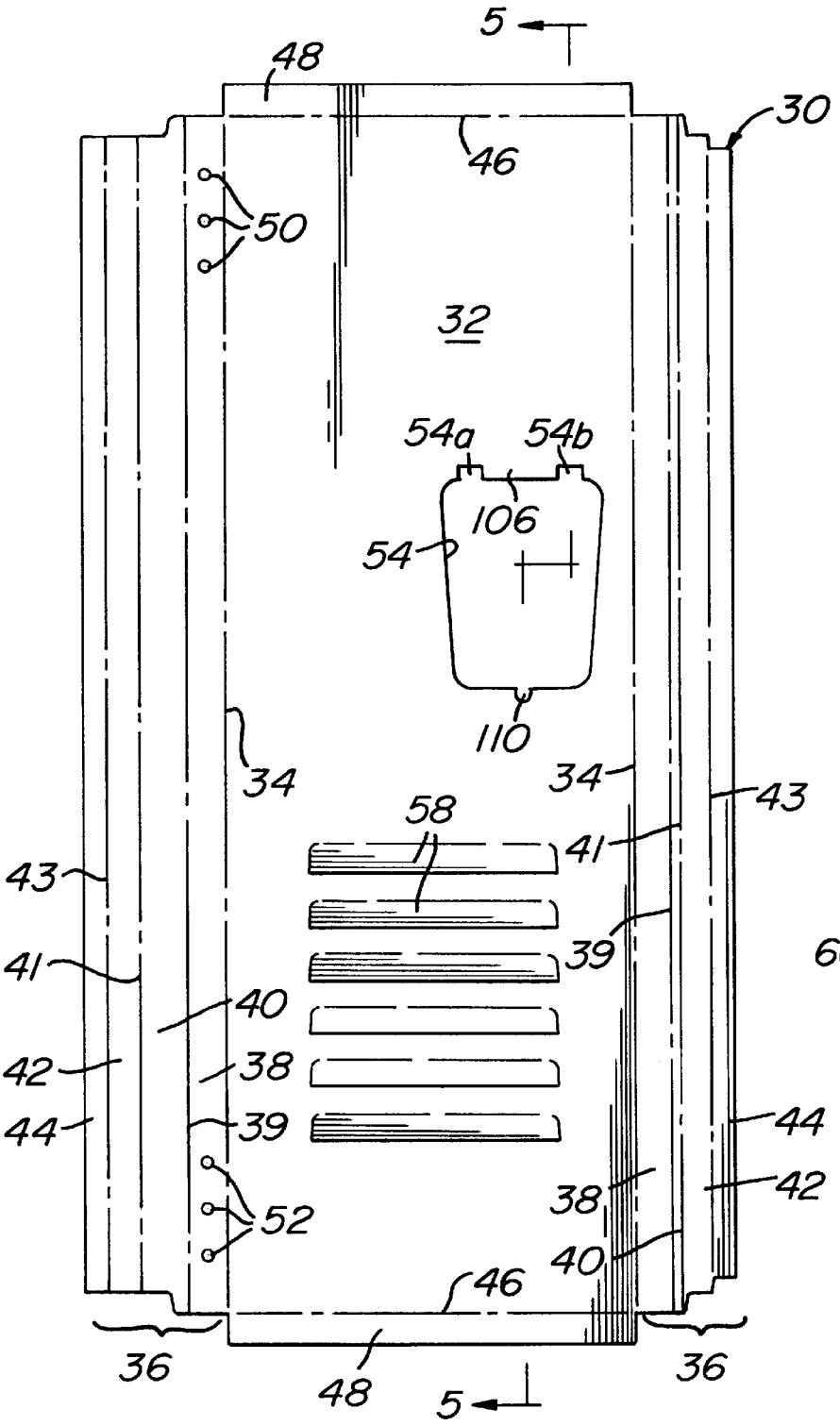
FIG. 4 is a plan view of the one-piece sheet metal blank from which the sheet metal door illustrated in FIGS. 1 and 2 may be formed.

Referring now to the drawings, one embodiment of a locker door and frame assembly in accordance with this invention is illustrated generally at 10 in FIGS. 1 and 2. The locker door and frame assembly 10 includes a peripheral frame 12 into which is set a one-piece sheet metal locker door 14.

As can be seen best in FIG. 1, the locker door and frame assembly 10 is illustrated as being mounted to the front end of a locker housing, which is indicated in phantom at 16.

Figure 6:
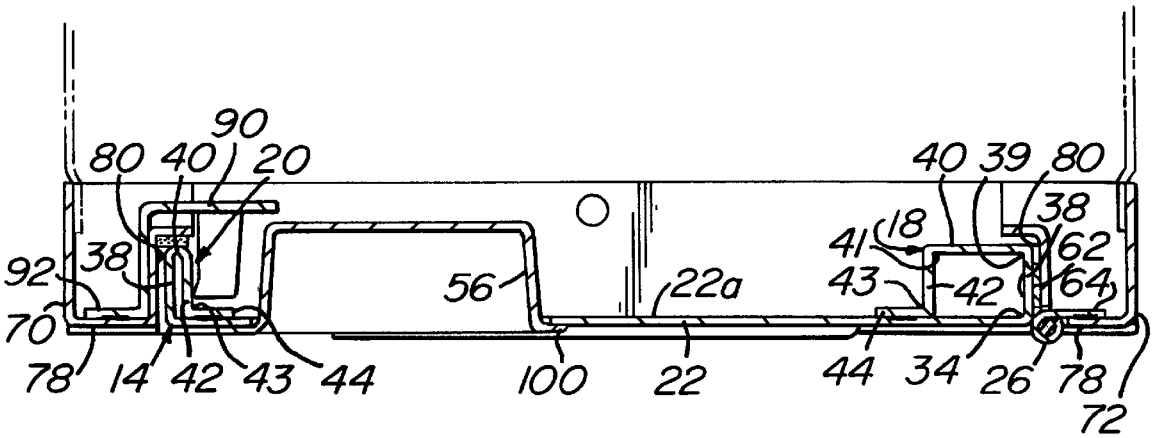
FIG. 6 is a sectional view taken along the stepped line 6—6 of FIG. 1.

As can be seen best in FIGS. 2 and 6, the one-piece sheet metal locker door 14 includes a pair of integral box beam supports 18 and 20 extending for substantially the entire longitudinal extent at the extreme side edges of a central rectangular panel 22 of said door. The box beam support 18 is located at the hinge side of the door and the box beam support 20 is located at the latch side of the door.

A pair of hinges 24 and 26 connect the door 14 to the frame 12 in longitudinally spaced apart regions located closely adjacent top and bottom edges of the door. However, as stated earlier in this application the number of hinges can be varied in accordance with this invention; the specific number of hinges not constituting a limitation on the broadest aspects of this invention. The manner in which the hinges 24 and 26 are connected to the door 14 and the frame 12 will be described in greater detail hereinafter.

Referring specifically to FIGS. 1–3, a single point latch system 28 is provided for locking the door 14 in a closed position in only a single location, as will be explained in greater detail hereinafter.

Referring to FIG. 4, a unitary sheet-metal blank from which the sheet metal door 14 is formed is illustrated at 30. This blank includes a central rectangular panel 32 which constitutes the central rectangular panel 22 of the completed door construction 14. In addition, the blank includes a pair of opposed vertical side edges and a pair of opposed end edges defining the margins of the panel 32. Each of the side edges is defined by a first outer marginal fold zone 34 extending along the length of the side of the central panel 32 outwardly beyond and along which is an outer portion 36. Each of the outer portions 36 is integral with the central panel 32 and is deformed in a manner to be described hereinafter, to provide the box beam supports 18 and 20 on the hinge and latch sides of the finished door 14, respectively.

Still referring to FIG. 4, each of the outer marginal portions 36 includes four marginal areas 38, 40, 42 and 44; each being separated from the other by outer fold zones 39, 41 and 43, respectively.

Each of the end edges of the central panel 32 is defined by a fifth outer marginal fold zone 46 extending for the entire transverse extent of the central panel 32. A second outer marginal portion 48 extends outwardly beyond each of the outer marginal fold zones 46 and is joined by this latter fold zone to the central panel 32. As can be seen best in FIG. 2, the second outer marginal portions are bent about their respective fold zones 46 into an orientation substantially perpendicular to front panel 22 of the door, to both strengthen the door and to provide a cover for the marginal edges of the box beam supports 18, 20. If desired the outer marginal portions 48 can be welded to overlying contacting edges of the box beam supports 18, 20.

As can be seen best in FIG. 4, a section of each of the outer marginal portions 36 is relieved to provide access for tooling employed to bend the marginal portions 36 into the integral box beam supports 18 and 20.

Still referring to FIG. 4, the marginal area 38 which is included as part of the box beam support 18 on the hinge side of the completed locker door 14 includes a series of three spaced apart apertures 50 adjacent an upper edge of the blank, and a series of three spaced apart apertures 52 adjacent a lower edge of the blank. These apertures are for receiving suitable fasteners, e.g., screws, rivets, etc. for securing spaced apart hinges to the completed door.

Still referring to FIG. 4, the central panel 32 of door 14 is provided with a cut-out region 54 close to the first marginal fold zone 34 at the latch side of the completed door for receiving a recessed pocket and door pull member 56 of the single-point latch system 28 (FIGS. 1–3).

Still referring to FIG. 4, the structure of the unitary sheet metal blank 30 is completed by the formation of elongate louvers 58 of a conventional design, providing air ventilating passageways 60 in the panel 32. Although the inclusion of ventilating passage means in the door 14 clearly is preferred, for some locker constructions it may be acceptable to eliminate such passage means entirely.

As can be seen best in FIG. 6, the box beam support 18 on the hinge side of the door essentially is rectangular in cross-section, and is provided by folding the first outer portion 36 on the hinge side of the sheet metal blank 30 along the respective fold zones 34, 39, 41 and 43. In this manner, the marginal area 38 is at the extreme side margin of the central rectangular door panel 22 and has one of the hinge plates 62 of each of the hinges 24 and 26 secured thereto, either by screws, rivets, spot welds or other similar fastening means. As illustrated in FIGS. 2 and 6, rivets are employed.

Referring to FIG. 6, the outermost marginal area 44 on the side of the blank 30 on which the box beam support 18 is formed is folded substantially perpendicular to marginal area 42 along the fold zone 43, to lie substantially flush against inner surface 22*a* of the door 14. This marginal area 44 is spot welded to the rectangular panel 22 of the door 14 in spaced-apart intervals of 4 inches. Of course, the spacing of the spot welds can be varied, as desired, and does not constitute a limitation on the present invention.

Still referring to FIG. 6, the box beam support 20 on the latch side of the door is provided by folding the first outer marginal portion 36 on the latch side along the four marginal fold zones 34, 39, 41 and 43. It should be noted that the marginal area 40 included in the box beam support 20 is substantially curved or rounded, as compared to the substantially linear orientation of this same marginal area 40 in the box beam support 18 on the hinge side of the door. This difference in orientation results from the fact that the box beam support 20 on the latch side of the door, in the most preferred embodiment of this invention, has a width substantially smaller than the width of the box beam support 18 on the hinge side of the door.

Still referring to FIG. 6, it should be noted that the marginal areas 38, 42 and 44 employed to form the box beam support 20 on the latch side of the door are oriented and folded in the same manner as the corresponding marginal areas employed to form the box beam support 18 on the hinge side of the door. In particular, the outer most marginal area 44 of the box beam support 20 is folded along the marginal fold zone 43 into a position where it is generally flush against the inner surface 22*a* of the central rectangular door panel 22, and is spot welded to the door panel by spot welds that are spaced apart along the length of the box beam support 20 in 4 inch increments (See FIG. 2). Of course, as stated above with respect to the box beam support 18, the spacing of the spot welds can be varied, as desired, and does not constitute a limitation on the present invention.

In fact, alternative fastening means for securing the box beam supports 18 and 20 in their formed condition also can be employed. The specific manner of securing the box beam supports 18 and 20 in their formed condition does not constitute a limitation on the present invention. Most desirably the fastening means should enhance the strength and structural integrity of the door.

Referring specifically to FIGS. 1, 2 and 6, the peripheral frame 12 includes transversely spaced apart side frame members 70, 72 and vertically spaced apart top and bottom frame members 74, 76. Each of the side frame members 70, 72 and top and bottom frame members 74, 76 includes a forwardly facing outer surface 78 on a front wall thereof. The side frame members 70, 72 each include a transversely facing side surface 80 on an inner side wall thereof. The top and bottom frame members 74, 76 include downwardly and upwardly facing side surfaces 82, 84, respectively, on inner side walls thereof. It should be understood that the specific cross-sectional configuration of the various frame members can be varied as desired, and does not constitute a limitation on the broadest aspects of this invention.

Referring specifically to FIG. 6, each of the hinges 24 and 26 includes a hinge plate 64 that is secured to the side frame member 72 in an identical manner. Specifically, the hinge plate 64 of the hinge 26 extends through an elongate slot formed adjacent the junction of the front wall and inner side wall of the side frame member 72, and is spot welded to the inwardly facing surface of the front wall. However, the attachment point for the hinge plate 64 on the side frame member 72 can be varied, but should be in a location that conceals said plate when the locker door is in a closed position.

Referring to FIGS. 1, 2 and 6, when the door 14 is in a closed condition it is seated completely within the peripheral frame 12, with the first marginal area 38 of each of the integral box beam supports 18 and 20 being disposed in contiguous, overlying relationship with an adjacent transversely facing side surface 80 of each of the side frame members 70, 72, and with the outer marginal portions 48 constituting the top and bottom wall of the door 14 in overlying relationship with adjacent downwardly and upwardly facing side surfaces 82, 84, of the top and bottom frame members 74, 76, respectively. Moreover, as can be seen best in FIGS. 1 and 6, the mounting fasteners or other fastening means securing the hinge plates 62 of the hinges 24 and 26 to the marginal area 38 of the box beam support 18 is contiguous with and in overlying relationship with a closely adjacent transversely facing side surface 80 of the side frame member 72 to thereby make it extremely difficult for a vandal to remove the hinges, for the purpose of gaining access to the interior of the locker.

Referring to FIGS. 2 and 6, in the preferred embodiment of the invention the box beam support 18 is substantially wider than the box beam support 20 and provides substantial stiffness and rigidity to the door to resist twisting forces imparted to the hinge side of the door through normal usage, and also in the event that a vandal attempts to pry the door open from the latch side of the door.

Most preferably the box beam support 20 at the latch side of the door 14 is narrower than the box beam support 18 at the hinge side, but still adds desired rigidity and stiffness to the door along the latch side of the door to resist the prying or bending of the latch side of the door away from the peripheral frame 12.

In a representative embodiment of this invention, the width of the box beam support 18 at the hinge side of the door 14, as measured between the first outer marginal fold zone 34 and the marginal outer side edge of the marginal area 44, is approximately 1.75 inches. In this same representative embodiment the width or transverse dimension of the box beam support 20 on the latch side of the door, as measured between the first outer marginal fold zone 34 and the outer side edge of the marginal area 44, is approximately 0.812 inches. In a 12 inch locker door and frame assembly, wherein the width of the locker door is approximately 9.875 inches, over 7 inches of width between the spaced-apart outer side edges of the marginal areas 44 is unimpeded by other structural members, and is available for the receipt of air ventilating passages therein, which can be formed or punched in an easy and reliable manner.

Figure 5:
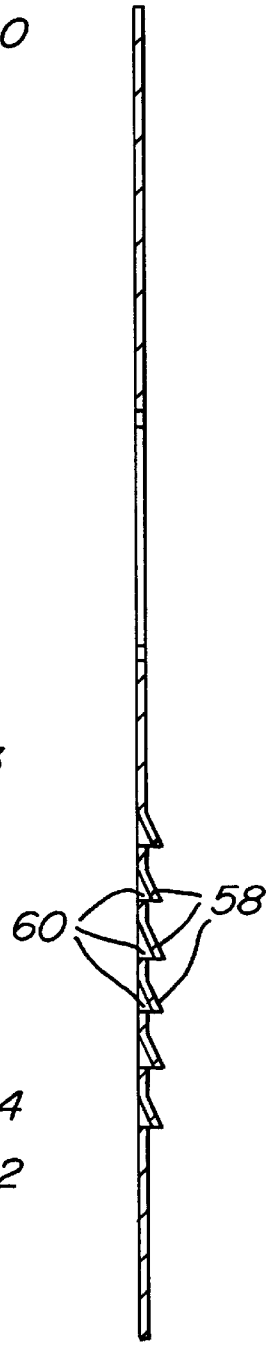
FIG. 5 is a sectional view taken along line 5—5 of FIG. 4.

As can be seen best in FIGS. 1, 2 and 5, the louvers 58 provide the air passages 60 in the central unobstructed region of the rectangular door panel 22. This permits desired venting of the interior compartment of the locker to the outside environment. It should be understood that a variety of different shapes and forms of air passages can be included in the locker door 14 in accordance with the broadest aspects of this invention. For example, and not by way of limitation, the air ventilating passages can be in the form of square openings, triangular openings, rectangular openings, etc. In fact, although not as preferred, air passages can be provided in the form of spaced apart circular or elongate openings in the outer marginal portions 48 of the door, which, in the completed door construction, are bent inwardly to overlie adjacent end edges of the box beam supports 18 and 20. As stated earlier herein, these top and bottom portions 48, if desired, can be bonded to contiguous contacting edges of the box beam support 18 and 20.

Figure 7:
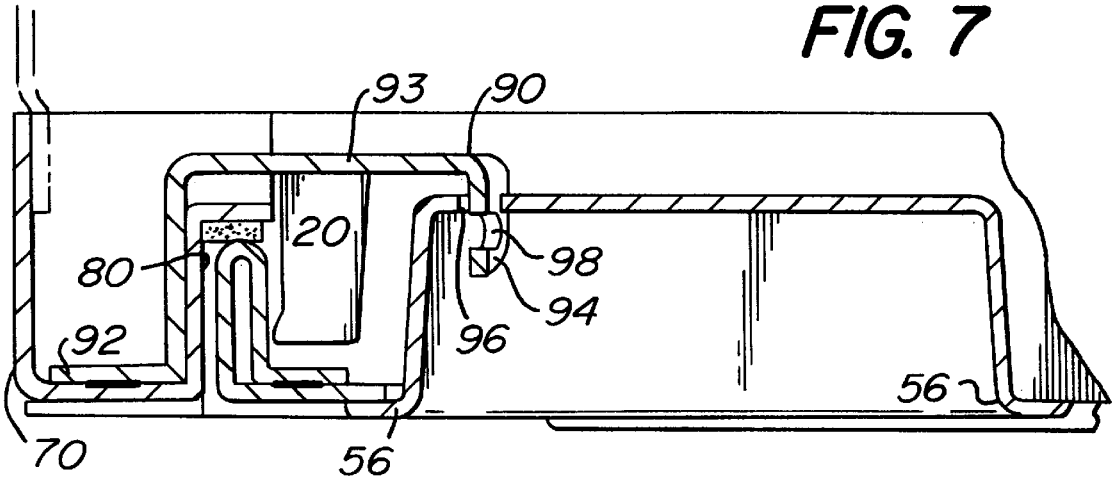
FIG. 7 is a sectional view taken along line 7—7 of FIG. 3.

Referring specifically to FIGS. 2 and 7, the box beam support 20 located at the latch side of the door is purposefully made so that the recessed pocket and door pull member 56 of the single point latch system 28 can be positioned close to the side margin of the door 14, and thereby cooperate with a corresponding latch member 90 that need not extend far into the open area into the locker casing 16. If the latch member 90 is required to extend far into the open area into the locker casing it will present an undesired obstruction both for placing articles in, and removing articles from the casing.

It is very desirable to mount the recessed pocket and door pull member 56 as close as possible to the side margin of the door without interfering with the box beam support 20. In this manner, the box beam support 20 provides the desired stiffness at the latch end of the door to resist the efforts of vandals to gain access to the interior of the locker by prying the locker door 14 away from the peripheral frame 12 at the latch side of the door. Moreover, the wider box beam support 18 at the hinge side of the door 14 provides the desired stiffness to resist the twisting torque imposed upon the hinge side when a vandal attempts to pry the door open from the latch side, or when the locker is just excessively abused in use.

Although in the preferred embodiment the box beam support 18 at the hinge side of the door 14 is wider than the box beam support 20 at the latch side of the door, for the reasons indicated above, it is within the broad scope of this invention to form the box beam supports of the same width, and even, if desired, to form the box beam support at the latch side wider than the box beam support at the hinge side. However, clearly the most preferred arrangement is to form the box beam support at the hinge side wider than the box beam support at the latch side.

Referring specifically to FIGS. 1–3, 7 and 8, details of the single point latch system 28 will be described. However, it should be understood that the specific single point latch system 28 disclosed herein is for purposes of illustration only, and is one of many types of single point latch systems usable in this invention.

What is significant is that the door and frame assembly 10 of this invention has specially advantageous properties when employed with a single point latch system located intermediate the upper and lower ends of the door. Specifically, when such a single point latch system is employed it is extremely important that the latch side of the door be sufficiently stiffened so as to resist a vandal's efforts to pry the door away from the peripheral frame from the upper and lower ends of said door. Keep in mind that in this type of latch system the door 14 is not latched, or locked, to the frame adjacent the top and bottom surfaces of the side frame member. Thus, these latter two regions present areas in which a tool can be inserted to attempt to pry the door away from the frame 12.

The single point latch system 28 includes a recessed pocket and door pull member 56 secured to the rectangular panel 22 of the door 14, and a cooperating lug 90 having one distal end 91 seated and secured within an interior recess of the side frame member 70. Specifically, the lug 90 includes a segment 92 thereof spot welded to the rearwardly facing surface of the front wall at spaced apart locations. The opposite distal end of the lug 90 includes a staple 94 extending in a forward direction, and this staple is positioned to be received within an elongate, angled opening 96 provided in the base of the recessed pocket of the pocket and door pull member 56 when the door 14 is in a closed position within the frame 12, as is illustrated best in FIGS. 1, 3, 7 and 8.

Figure 8:
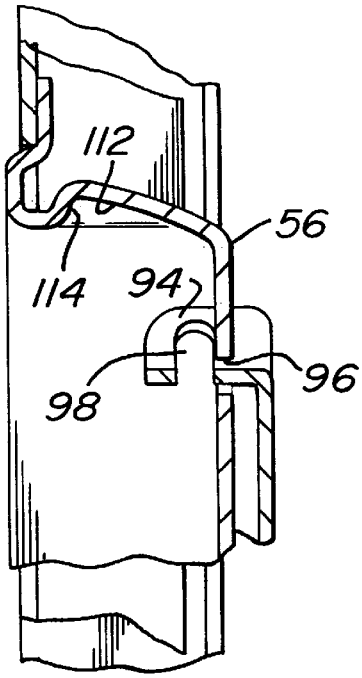
FIG. 8 is a sectional view taken along line 8—8 of FIG. 3.

As can be seen in FIGS. 2, 7 and 8, the staple 94 includes an elongate opening 98 in it for receiving a lock or other fastening means when the staple projects through the elongate opening 96 in the recessed pocket and door pull member 56. A representative, standard lock is shown in phantom in FIG. 3.

It should be noted that the staple end of the lug 90 is joined to the opposed distal end 91 by a section 93. As explained earlier, it is desirable to keep the transverse dimension of the lug 90, and therefore the transverse dimension of the web section 93 thereof, as small as possible so that the lug will not extend excessively into the opening into the locker casing 16 and interfere with the placement of the objects in, and the removal of objects from the casing. By designing the box beam support 20 of a relatively narrow width, as discussed above, this objective is achieved.

As can be seen and understood best from FIGS. 1, 2 and 4, the recessed pocket and door pull member 56 includes an outer peripheral flange 100 overlying the margin of the central door panel 22 contiguous to the cut-out 54 (FIG. 4) on the outer side of the door. The recessed pocket and door pull member 56 is retained within the cut-out by the cooperation of the flange 100 with two, transversely spaced apart, rearwardly and upwardly extending flanges 102, 104 that also are formed as part of the member 56. The upwardly extending portions of these latter flanges are spaced from flange 100 by the thickness of the door panel 22. The recessed pocket and door pull member 56 is inserted into cut-out 54 from the front of the door, with the flanges 102, 104 passing through recessed sections 54*a*, 54*b* of the cut-out 54 (FIG. 4). Thereafter, the member 56 is moved upwardly to cause tab section 106 formed between the recesses 54*a*, 54*b* to seat behind the flange 100 and to cause the sections of the panel immediately above the recesses 54*a*, 54*b* to seat between flange 100 in the front and the flanges 102, 104 in the rear. In this position a passage 108 in flange 100 (FIG. 3) is aligned with lower recess 110 of cut-out 54 (FIG. 4), and a screw or other fastener is secured through the passage 108 and the lower recess 110 to retain the member 56 within the door 14.

As can be seen best in FIG. 8, upper surface 112 of the interior pocket of member 56 is recessed to provide a rearwardly facing ledge 114 that can be easily gripped for the purpose of opening the locker door 14.

Figure 9:
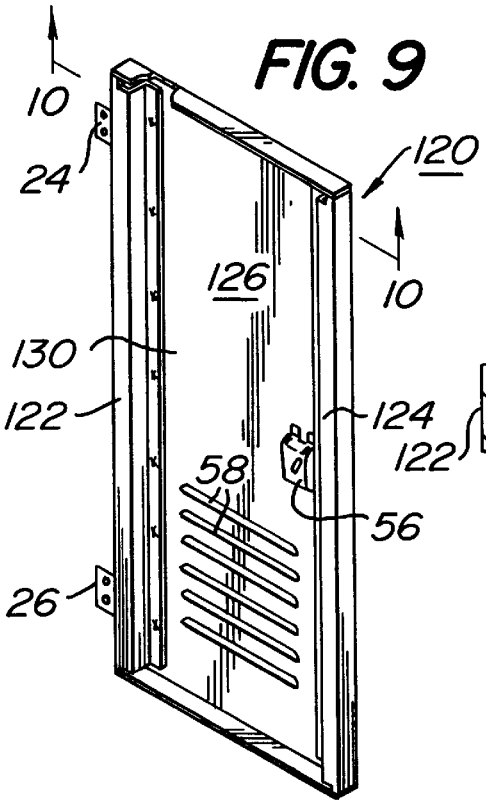
FIG. 9 is an isometric view of the rear side of an alternative embodiment of a locker door utilizable in the assembly of this invention, with the front side of the locker door being identical in appearance to the front side of the locker door shown in FIG. 1.
Figure 10:
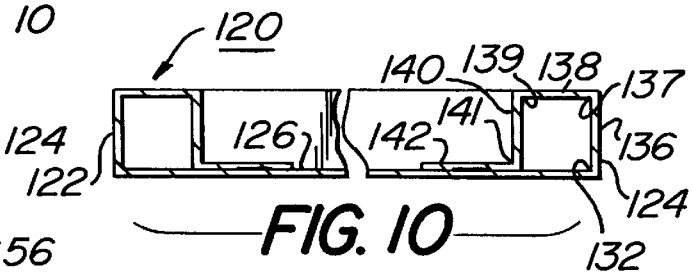
FIG. 10 is a sectional view taken along the line 10—10 of FIG. 9.

Referring to FIGS. 9 and 10 there is illustrated a one-piece sheet metal locker door 120 having a pair of integral box beam supports 122, 124 extending along the extreme side edges of the door and constructed in accordance with another embodiment of the present invention. It should be understood that the locker door 120 is employed with and connected to the peripheral frame 12 in the same manner as the locker door 14 described previously herein. Moreover, the locker door 120, like the locker door 14, preferably includes air ventilating louvers 58 or other air ventilating passage means, as well as spaced apart hinges 24 and 26 (or other hinge means) secured to the door 120 and to the peripheral frame 12 in the identical manner as the door 14. In addition, the locker door 120 includes a recessed pocket and latch member 56 identical to the one employed in the door 14 for cooperating with a locking lug 90 on the frame that is similar to the locking lug 90 employed on the frame 12; the only difference being in the transverse dimension of the lug 90 dictated by the difference in the transverse dimension of the box beam support 124 relative to the transverse dimension of the box beam support 20 of the door 14. In fact, the only distinction between the locker door 120 and the locker door 14, is that on the locker door 120 the box beam supports 122, 124 on the hinge and latch sides thereof are substantially of the same width.

Figure 11:
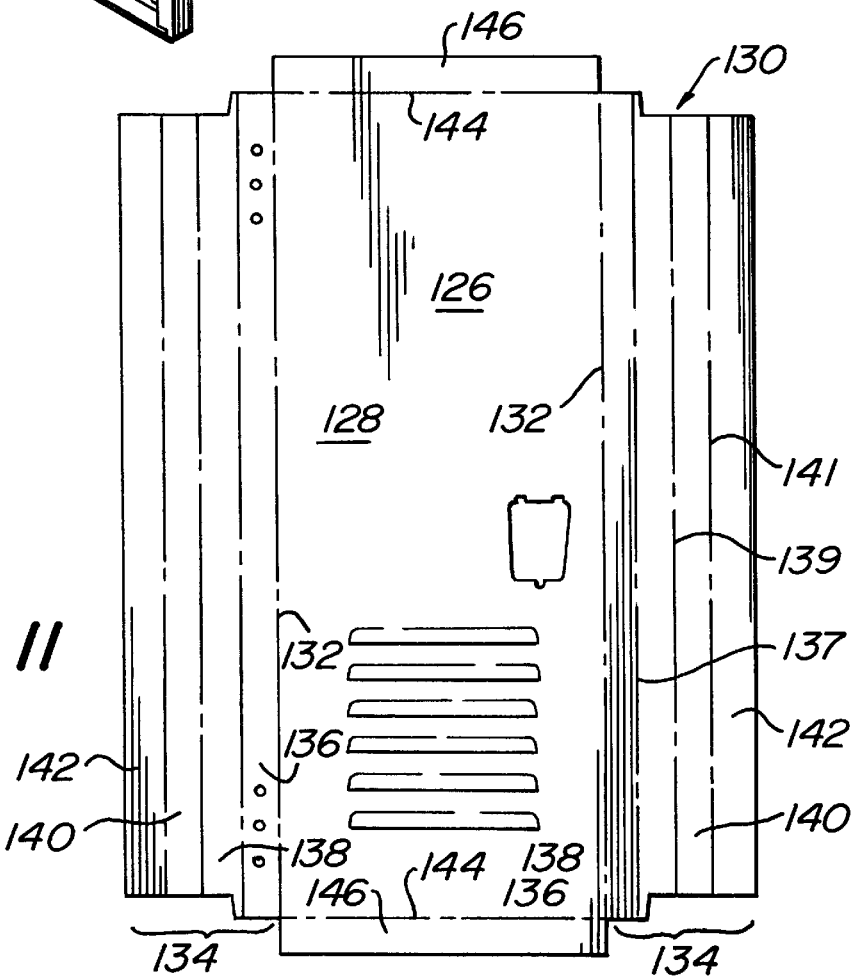
FIG. 11 is a plan view of the one-piece sheet metal blank from which the door of FIG. 9 may be formed.

Specifically, the locker door 120 is formed from sheet metal blank 130 shown in FIG. 11. The door 120 includes a central rectangular panel 126 having an outer surface 128 and inner surface 130. The central panel 126 has a pair of opposed vertical side edges and a pair of opposed end edges defining the margins of the panel. Each of the side edges is defined by a first outer marginal fold zone 132 extending along the length of the side outwardly beyond and along which is an outer portion 134, FIG. 11, integral with the panel 126. Each of the marginal portions 134, FIG. 11, has four marginal areas, 136, 138, 140 and 142, each separated from the other by outer fold zones 137, 139 and 141. The end edges of the panel 126 are defined by a fifth outer marginal fold zone 144 extending the length of the panel and outwardly beyond and along which is a second outer marginal portion 146 integral with the panel 126.

As may be seen in FIG. 10, the first marginal area 136 is folded along the first outer marginal fold zone 132 until it is approximately perpendicular to the panel 126 and extending outwardly from the inner surface 130, thereof. The second marginal area 138 is folded along the marginal fold zone 137 to a position where it is approximately perpendicular to the first marginal area 136 and is parallel to the inner surface 130 of the panel 126. The third marginal area 140 is folded along the fold zone 139 so that it is approximately perpendicular to the panel 126 and to the second marginal area 138 and parallel to the first marginal area 136. The fourth marginal area 142 is folded along the fold zone 141 toward the opposite edge of the panel 126 so as to be approximately perpendicular to the third marginal area 140 and flush against the inner surface 130 of the panel 126.

As may be seen in FIG. 9, by folding the sheet metal blank 130 in the above described manner there is formed along each of the extreme side edges of the panel 126 an integral box beam support 122, 124. At the end edges of the panel 126 the outer marginal portion 146 is folded approximately perpendicular to the inner surface 130 of the panel along the outer marginal fold zone 144 so that it extends over the ends of the integral box beam supports 122, 124; thereby strengthening the locker door 120 and providing a cover for the ends of the box beam supports.

A cross-section of the box beam supports 122, 124 extending along the extreme side edges of the panel 126 is shown in FIG. 10. To enhance the rigidity of each of the box beam constructions, the flange portion provided by the fourth marginal area 142 is spot welded to the inner surface 130 of the central door panel at spaced-apart locations along the length, in the same manner as in the door 14 thereof. The marginal portion 146 at the top and bottom of the door may also be welded at the ends thereof to corresponding contacting ends of the box beam supports 122, 124 for additional strength.

Referring to FIGS. 12 and 13, there is illustrated another embodiment of a one-piece sheet metal locker door 200 having a pair of integral box beam supports 202, 204 extending along the extreme side edges of the door and constructed in accordance with the present invention.

It should be understood that the locker door 200 is employed with, and connected to, the peripheral frame 12 (not shown) in the same manner previously herein 14 described previously herein. Moreover, the locker door 200, like the locker door 14, preferably includes air-ventilating louvers 58 or other air ventilating means, and spaced-apart hinges 24 and 26 (or other hinge means) secured to the door 200 and to the peripheral frame 12 in the identical manner as the door 14. In addition, the locker door 200 includes a recessed pocket and latch member 56 identical to the one employed in the door 14 for cooperating with a locking lug on the frame that is identical to the locking lug 90 employed on the frame 12 in the locker door and frame assembly 10, with the exception that the transverse dimension of the locking lug 90 employed with the locker door 200 is different from the transverse dimension of the lug 90 employed with the locker door 14, due to the difference in the transverse dimensions of the box beam supports 20, 204 on the latch sides of those doors.

The only distinction between the locker door 200 and the locker door 14, is that in the locker door 200 the box beam supports 202, 204 on the hinge and latch sides thereof are of a different cross-sectional configuration and are of substantially the same width.

Specifically, the door 200 is formed from a sheet metal blank 210 shown in FIG. 14. The door 200 includes a central rectangular panel 212 having an outer surface 213 and an inner surface 214. The central panel 212 has a pair of opposed vertical side edges and a pair of opposed end edges defining the margins of the panel. Each of the side edges is defined by a first outer marginal fold zone 215 extending along the length of the side outwardly beyond and along which is an outer portion 216, FIG. 14, integral with the panel 212. Each of the marginal portions 216, has three marginal areas, 217, 219 and 220, each separated from the other by outer fold zones 221, and 223. The end edges of the panel 212 are defined by a fourth outer marginal fold zone 224 extending the length of the end outwardly beyond and along which is a second outer marginal portion 225 integral with the panel 212.

As may be seen in FIG. 13, the first marginal area 217 is folded along the marginal fold zone 215 until it is approximately perpendicular to the panel 212 and extending outwardly from the inner surface 214 thereof. The second marginal area 219 is folded along the marginal fold zone 221 to a position where it forms an acute angle with respect to the first marginal area 217 and is connected to the third marginal area 220 by the fold zone 223. The third marginal area 220 is folded along the fold zone 223 toward the opposite edge of the panel so it is flush against the inner surface 214 of the panel 212.

As may be seen in FIG. 13, by folding the sheet metal blank 210 in the above described manner there is formed along each of the extreme side edges of the panel 212 an integral three-sided box beam support 202, 204, respectively. At the end edges of the panel 212 the outer marginal portions 225 are folded approximately perpendicular to the inner surface 214 of the panel along the outer marginal fold zones 224 so that they extend over the ends of the integral box beam supports 202, 204, thereby strengthening the locker door 200 and providing a cover for the ends of the box beam supports.

A cross-section of the three-sided box beam supports extending along the extreme side edges of the panel 212 is shown in FIG. 13. To enhance the rigidity of the box beam construction, the flange portions 220 provided by marginal areas 220 are spot welded to the inner surface 214 of the panel 212 at spaced-apart locations along the length thereof, in the same manner as in the door 14. The flanges provided by marginal portions 225 at the top and bottom of the door may also be welded at the ends thereof to corresponding contacting ends of the box beam supports 202, 204 for additional strength. While the box beam supports 202, 204 shown in FIG. 13 are both the same size, they may be of different sizes if desired. For example, the width of the box beam support 204 on the latch side of the door may be smaller than the width of the box beam support 202 on the hinge side of the door for the same reasons discussed above in connection with the locker door and frame assembly 10.

The double box beam doors 14, 120 and 200 employed in the locker door and frame assemblies of this invention have numerous advantages. Since they are made from a single piece of sheet metal material they use the least amount of material. They are easily roll formed since no secondary or supplemental supports such as extra braces and supports need be added. By forming the integral box beam supports at the extreme edges of the door, the rigidity is provided where it is needed. In addition to providing a rigid structure for installation of the hinges for the door, the box beam supports at the extreme sides also provide an unobstructed area centrally of the panel so that louvers and/or other perforations for ventilating the interior of the locker can be placed in their normal positions. Although the locker doors employed in the present invention are made from a single piece of sheet metal, their integral box beam construction provides rigidity for the door comparable to other designs of locker doors incorporating multiple, separate structural parts.

While there have been described preferred embodiments of the invention, it will be understood that further modifications may be made without departing from the spirit and scope of the invention as set forth in the appended claims.

What is claimed is:

1. A locker door and frame assembly, said assembly including;

a one-piece metal locker door having a central rectangular panel and a pair of integral box beam supports, said rectangular panel having outer and inner surfaces, a pair of opposed side edges, and a pair of opposed end edges, said integral box beam supports being at the extreme side edges of said rectangular panel, each of said side edges being provided by a first outer marginal fold zone extending the length of the side and each of said box beam supports being provided by a marginal portion of said locker door integrally joined to said panel through a respective first outer marginal fold zone and extending outwardly of said panel, each of said marginal portions including multiple, adjacent marginal areas integrally joined to each other through additional marginal fold zones spaced outwardly from said first outer marginal fold zone, said marginal areas of each of said marginal portions being bent along said first outer marginal fold zone and said additional marginal fold zones to form each of said integral box beam supports, each of said integral box beam supports including a first marginal area joining said panel through said first outer marginal fold zone and extending approximately perpendicular to said panel and outwardly from said inner surface at the extreme side edge of said panel, each of said integral box beam supports including at least two additional marginal areas within the perimeter of said panel and being bent relative to each other along one of said additional marginal fold zones, one of said at least two additional marginal areas being directed inwardly toward said inner surface and the other of said at least two additional marginal areas extending parallel to and flush against the inner surface of said panel and being joined to said one of said at least two additional marginal areas by one of said additional fold zones, said one of said additional fold zones being transversely spaced inwardly from the first outer marginal fold zone;

said frame including transversely spaced apart side frame members having outwardly facing front surfaces and transversely spaced-apart, side surfaces that face each other, said metal locker door being disposed within the frame with the first marginal area of each of said integral box beam supports being disposed in contiguous, overlying relationship with an adjacent side surface of said frame and with no portion of said locker door overlying an outwardly facing front surface of said frame;

hinge means directly connected to a first marginal area of one of said integral box beam supports and to an adjacent side frame member for pivotally connecting said locker door to said frame through one of said integral box beam supports;

a single-point latch means adjacent the side edge of the door remote from the hinge means for use in locking the door to the frame at only a single location spaced intermediate the opposed end edges of the door.

2. The locker door and frame assembly of claim 1, wherein each of said end edges is defined by a further additional outer marginal fold zone extending the length of the end outwardly beyond and along which is a second outer marginal portion integral with said panel, said second outer marginal portion being folded perpendicular to said panel along said further additional outer marginal fold zone and over ends of said integral box beam supports, said frame including vertically spaced apart top and bottom frame members having downwardly and upwardly facing top and bottom side surfaces, respectively, said locker being disposed within the frame with the second outer marginal portion being disposed in contiguous, overlying relationship with an adjacent downwardly and upwardly facing top and bottom side surface of said top and bottom frame members.

3. The locker door and frame assembly of claim 1, wherein said other of said at least two additional marginal areas that extends parallel to and flush against the inner surface of the panel being welded to the inner surface of said panel at spaced-apart locations along the length thereof.

4. The locker door and frame assembly of claim 2, wherein said other of said at least two additional marginal areas that extends parallel to and flush against the inner surface of the panel being welded to the inner surface of said panel at spaced-apart locations along the length thereof.

5. The locker door and frame assembly of claim 1, wherein said one of said integral box beam supports to which the hinge means is connected is wider than the box beam support adjacent the single-point latch means.

6. The locker door and frame assembly of claim 2, wherein said one of said integral box beam supports to which the hinge means is directly connected is wider than the box beam support adjacent the single-point latch means.

7. The locker door and frame assembly of claim 1, wherein both of the box beam supports are substantially the same width.

8. The locker door and frame assembly of claim 1, wherein said at least one of said integral box beam supports to which the hinge means is connected is of a quadrilateral cross-section.

9. The locker door and frame assembly of claim 1, wherein said at least one of said integral box beam supports to which the hinge means is directly connected is of a triangular cross-section.

10. The locker door and frame assembly of claim 8, wherein the box beam support on the side of the locker door opposite the hinge side includes transversely spaced-apart marginal areas extending generally inward from the inner surface of the rectangular panel of the door and being joined at a distal end through a curved marginal area.

11. The locker door and frame assembly of claim 10, wherein said transversely spaced-apart marginal areas of the box beam support on the side opposite the hinge side are substantially parallel to each other.

12. The locker door and frame assembly of claim 1, wherein the other of said at least two additional marginal areas of the box beam support at the side edge of the door remote from the hinge side terminates at a distal edge, said single-point latch means including a member attached to the rectangular panel of the door closely adjacent said distal edge.

13. The locker door and frame assembly of claim 5, wherein the other of said at least two additional marginal areas of the box beam support at the side edge of the door remote from the hinge side terminates at a distal edge, said single-point latch means including a member attached to the rectangular panel of the door closely adjacent said distal edge.

14. The locker door and frame assembly of claim 11, wherein said single-point latch means further includes a member attached to the side frame member remote from the hinge means for cooperating with the member attached to the door for use in locking the door to the frame in a closed condition.

15. The locker door and frame assembly of claim 1, further including ventilating passage means in said locker door.

16. The locker door and frame assembly of claim 15, wherein said ventilating passage means is included in the central panel of said locker door.

17. The locker door and frame assembly of claim 2, further including ventilating passage means in said locker door.

18. The locker door and frame assembly of claim 17, wherein said ventilating passage means is included in the central panel of said locker door.

19. The locker door and frame assembly of claim 5, further including ventilating passage means in said locker door.

20. The locker door and frame assembly of claim 19, wherein said ventilating passage means is included in the central panel of said locker door.

21. The locker door and frame assembly of claim 1, wherein said other of said at least two additional marginal areas being attached to the inner surface of said panel.

22. The locker door and frame assembly of claim 21, wherein said other of said at least two additional marginal areas being attached to the inner surface of said panel by welds.

* * * * *